US005566477A

United States Patent [19]

Mathis et al.

[11] Patent Number: 5,566,477

[45] Date of Patent: Oct. 22, 1996

[54] REMOVABLE SHOELACE COVER FOR A SHOE

[76] Inventors: Leroy Mathis, 1817 Oltorf, Apt. 1106, Austin, Tex. 78741; Cheryl McClellan, 19470 Pennington, Detroit, Mich. 48221

[21] Appl. No.: 225,134

[22] Filed: Apr. 8, 1994

[51] Int. Cl.[6] ..... A43B 3/24; A43B 23/00

[52] U.S. Cl. ..... 36/100; 36/132; 36/136; 36/54; 36/72 R

[58] Field of Search ..... 36/1, 100, 101, 36/132, 136, 131, 54, 50.1, 72 R

[56] References Cited

U.S. PATENT DOCUMENTS

| | | | |
|---|---|---|---|
| 234,283 | 11/1880 | Hutton | 36/50.1 |
| 1,043,888 | 11/1912 | Wilson | 36/72 R |
| 1,162,011 | 11/1915 | Anderson | 36/50.1 |
| 1,171,582 | 2/1916 | Bertona | 36/72 R |
| 1,742,763 | 1/1930 | Gerard | 36/72 R |
| 2,833,058 | 5/1958 | Wilmanns et al. | 36/72 R |
| 3,242,597 | 3/1966 | George et al. | 36/72 R |
| 3,252,232 | 5/1966 | Smith | 36/72 R |
| 3,334,427 | 8/1967 | Edwards et al. | 36/72 R |
| 3,972,136 | 8/1976 | Epstein | 36/101 |
| 4,282,657 | 8/1981 | Antonious | 36/50.1 |
| 4,597,198 | 7/1986 | Schweitzer | 36/100 |
| 5,165,190 | 11/1992 | Smyth | 36/136 |
| 5,313,719 | 5/1994 | Koethe | 36/136 |

*Primary Examiner*—Paul T. Sewell
*Assistant Examiner*—Marie Denise Patterson
*Attorney, Agent, or Firm*—Harness, Dickey & Pierce, P.L.C.

[57] ABSTRACT

A shoelace cover incorporating an interchangeable fashion panel for covering the shoelaces of a gym shoe. The shoelace cover is secured to the shoe by a number of straps threaded through slots in the shoelace cover. A strap secured to each side of the gym shoe includes a loop and hook material such that the straps can be disengaged and the shoelace cover can be drawn back to expose the shoelaces of the shoe. The fashion panel is attached to the shoelace cover by a loop and hook material such that at the whim of the shoe wearer, the fashion panel can be replaced by other fashion panels to convey a fashion statement.

14 Claims, 2 Drawing Sheets

REMOVABLE SHOELACE COVER FOR A SHOE

BACKGROUND OF THE INVENTION

1. Field of the Invention

This invention relates generally to a decorative shoelace cover for a shoe and, more particularly, to a removable shoelace cover for a shoe used in association with a series of decorative fashion panels each being separately selectively engagable to the shoelace cover in order to convey a wide range of fashion statements.

2. Discussion of the Related Art

As is well understood, the main purpose of footwear is to offer a certain amount of protection for the feet of a wearer against the rigors of certain special or everyday activities. Manufacturers and designers of footwear typically incorporate a substantial amount of research and development in the production of footwear so that the footwear not only provides the desirable level of protection, but also provides a desirable level of comfort for the wearer and durability of the footwear. Many criteria go into the production of footwear in order to arrive at an acceptable product with at least these design criteria in mind. Footwear designed for particular activities may require additional design concerns. For example, athletic footwear would be designed in accordance with the special stresses placed on the footwear with respect to the particular athletic activities. Different concerns may be important for other types of footwear, such as for casual activities or for dress up occasions. The types of footwear designed for a particular occasion or activity is virtually limitless.

The factors going into the important concerns of comfort and durability when designing and producing footwear is generally only half the story. The other half concerns the aesthetics or fashionableness of the footwear. Accordingly, designers and manufacturers of footwear are aware of appearance characteristics of the footwear as much as they are aware of its comfort and durability. Because of the fashionableness of footwear, a wearer may wish to match his or her footwear to other parts of dress. Consequently, most people, especially women, may own a wide variety of different footwear or types of footwear not only for different occasions or activities, but also for different applications within an occasion or activity. Since shoes may be costly to purchase, one may be inclined to limit his or her supply of shoes below that which they may desire.

For the most part, athletic or gym shoes incorporate a rugged sole and attached upper portion, generally of leather or canvas. As is well understood, a section of the upper portion is open such that a wearer's foot can be easily inserted into the shoe. Typically, a series of laces operate to bind together the open section and conform the shoe to the wearer's foot. Although a gym shoe of this type typically is mostly concerned with support, comfort and durability, such shoes are also designed with fashion in mind. Therefore, it is known to possess several types of gym shoes of differing patterns and colors for use with different outfits, moods, etc.

Therefore, it is an object of the present invention to provide decorative cover panels for a shoe that are selectively removable to provide a varying choice of different colors and styles providing for different fashion statements. It is also an object of the present invention to provide a cover for the shoelaces which will inhibit interference of the shoelaces with foreign objects.

Thus, it would be advantageous to provide a shoe which could be readily adapted to provide varying patterns, fashions or the like in a single shoe. Such a shoe would be cost effective and would be useful in a variety of fashion situations.

Additionally, it is known that shoelaces, or other footwear securing devices, are prone to becoming untied as a result of interference with foreign objects or as a result of the user stepping on his/her own shoelaces. This is undesirable. Thus, it would be advantageous to provide a suitable cover which would protect the shoelace area from such mishap.

SUMMARY OF THE INVENTION

In accordance with the present invention there is provided a shoelace cover for a shoe, the shoelace cover may be removably secured to the shoe or may include a removable fashion panel such that the panel can be readily replaced with other panels in order to provide different "fashion statements" for the wearer without the need to change the shoe itself. In a first embodiment, the shoe is a gym shoe including shoelaces for securing the shoe to a wearer's foot. The shoelace cover is attached to the shoe over the shoelaces in order to provide a base area for supporting the fashion panel. The shoelace cover and the fashion panel include an associated securing device, such as a loop and hook material, so that the fashion panel can be secured to the shoelace cover and easily removed for replacement by other alternate fashion panels of differing styles or designs.

In another embodiment, the shoelace cover includes a series of three slots, where two of the slots are positioned at upper locations on the shoelace cover on opposite sides of the shoe, and a third slot is positioned at a lower central location of the shoelace cover opposite the opening where the wearer inserts his or her foot into the shoe. The shoelace cover is pivotally secured to the shoe by a strap at the central location. At left and right locations adjacent the opening where the wearer inserts his foot, a strap is rigidly secured to the shoe such that the strap is insertable in the associated slot at the upper location of the shoelace cover. In this manner, the upper portion of the shoelace cover adjacent the opening for inserting the wearer's foot is disengagable from the shoe such that the user is able to access the laces for securing the shoe to his foot.

Additional objects, advantages, and features of the present invention will become from the following description and appended claims, taken in conjunction with the accompanying drawings.

DETAILED DESCRIPTION OF THE PREFERRED EMBODIMENTS

The following discussion of the preferred embodiments concerning a gym shoe and associated shoelace cover and fashion panel is merely exemplary in nature and is in no way intended to limit the invention or its applications or uses.

Figure 1:
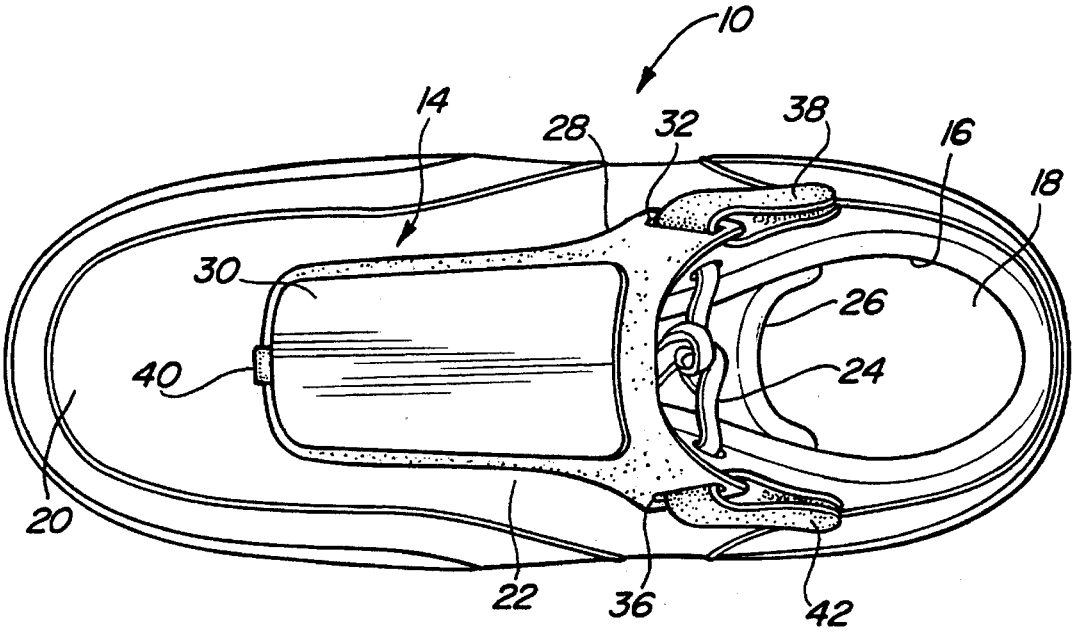
FIG. 1 is a top view of a shoe including a shoelace cover and fashion panel according to a preferred embodiment of the present invention.
Figure 2:
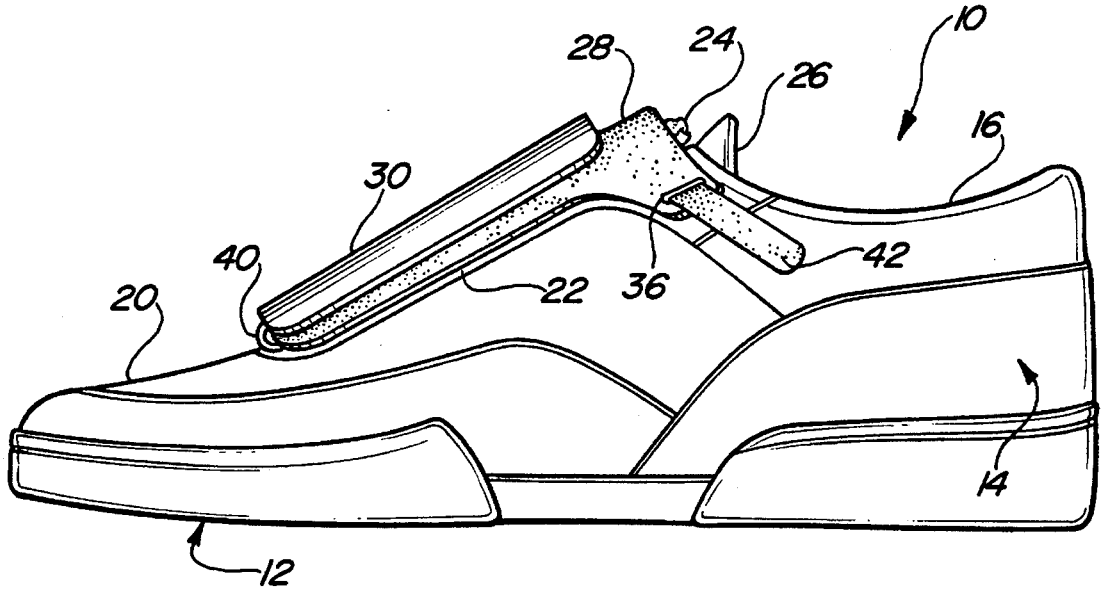
FIG. 2 is a side view of the shoe and associated shoelace cover and fashion panel shown in FIG. 1.

Turning to FIGS. 1 and 2, a top view and side view of a shoe 10 of the athletic or gym shoe type, is shown. The shoe 10 includes a sole portion 12, generally comprised of a rugged rubber material, and an upper portion 14 generally comprised of a durable and pliable leather or canvas material. At a back location of the upper portion 14 is an opening 16 for accepting a wearer's foot. A cushion 18 is visible through the opening 16 on which the wearer's foot is supported. At a front end of the upper portion 14 is a toe area 20. Extending from the toe area 20 to the opening 16 is a shoelace area 22. The shoelace area 22 is generally split such that a shoelace 24 is threaded through eyelets (see FIG. 3) associated with the shoelace area 22 in order to bind together the shoelace area 22 and secure the shoe 10 to the wearer's foot. A tongue 26, also extending from the toe area 20 to the opening 16, is positioned beneath the shoelace 24 such that the tongue 26 contacts the wearer's foot, and thus provides comfort against the shoelace 24 to the wearer. The basic components and operation of a gym shoe, such as shoe 10, is well understood to a person of normal sensibilities, and thus, a detailed discussion of the parts of the shoe 10 and their specific operation need not be elaborated on here.

Secured to the upper portion 14 of the shoe 10 covering the shoelace area 22 is a shoelace cover 28. In a preferred embodiment, the shoelace cover 28 is a semi-rigid panel that is curved to be shaped to conform to the shoelace area 22 such that an upper portion of the shoelace cover 28 extends a certain distance along the sides of the upper portion 14 adjacent the opening 16. The shoelace cover 28 narrows slightly as it extends towards the toe area 20. The specifics concerning the shape, dimensions, material, rigidity, etc. of the shoelace cover 28 will be discussed in greater detail below with respect to FIG. 4. Additionally, the preferred method of securing the shoelace cover 28 to the shoe 10 will also be discussed below.

In a preferred embodiment, affixed to a top surface of the shoelace cover 28 is a fashion panel 30. The fashion panel 30 is secured to the shoelace cover 28 by an applicable securing mechanism, such as a loop and hook and/or VELCRO® type fastener device, so that the fashion panel 30 can be readily removed from the shoelace cover 28 and replaced with an alternate fashion panel having a different design. The fashion panel 30 extends from a location proximate to the opening 16 to a location proximate to the flex area of the shoe 10 adjacent the toe area 20. The removable fashion panel 30 allows a wearer of the shoe 10 to selectively choose from any number of different fashion panels such that the shoe 10 can be transformed from one aesthetic design to another in accordance with the desires of the wearer. In this regard, the wearer can express himself or herself and make a "fashion statement" using the shoe 10 as an accent. Additionally, the shoe 10 can be allowed to conform with a particular outfit the wearer is wearing without having to retain a wide range of different shoes. Of course, shoes come in pairs, and therefore, the fashion panel 30 would probably be changed on both shoes. The specifics concerning the shape, dimensions, material, rigidity, etc. of the fashion panel 30 will be discussed below with reference to FIG. 5. While the fashion panel is a preferred embodiment, it is to be appreciated that the underlying cover 28 could be readily removable and replaceable with other like covers having fashion patterns to provide the desirable fashion result. This could be accomplished either separate from fashion panel 30 or in combination with the use of fashion panel 30.

In order to secure the shoelace cover 28 to the shoe 10, the shoelace cover 28 includes a first slot 32, a second slot 34 (see FIG. 4) and a third slot 36 cut into the shoelace cover 28 at an upper left location, a lower front location and an upper right location, respectively, as shown. A series of straps are attached to the upper portion 14 of the shoe 10, and threaded through the slots 32, 34 and 36 in order to secure the shoelace cover 28 to the shoe 10. Specifically, a first strap 38 is threaded through the slot 32, a second strap 40 is threaded through the slot 34 and a third strap 42 is threaded through the slot 36.

Figure 3:
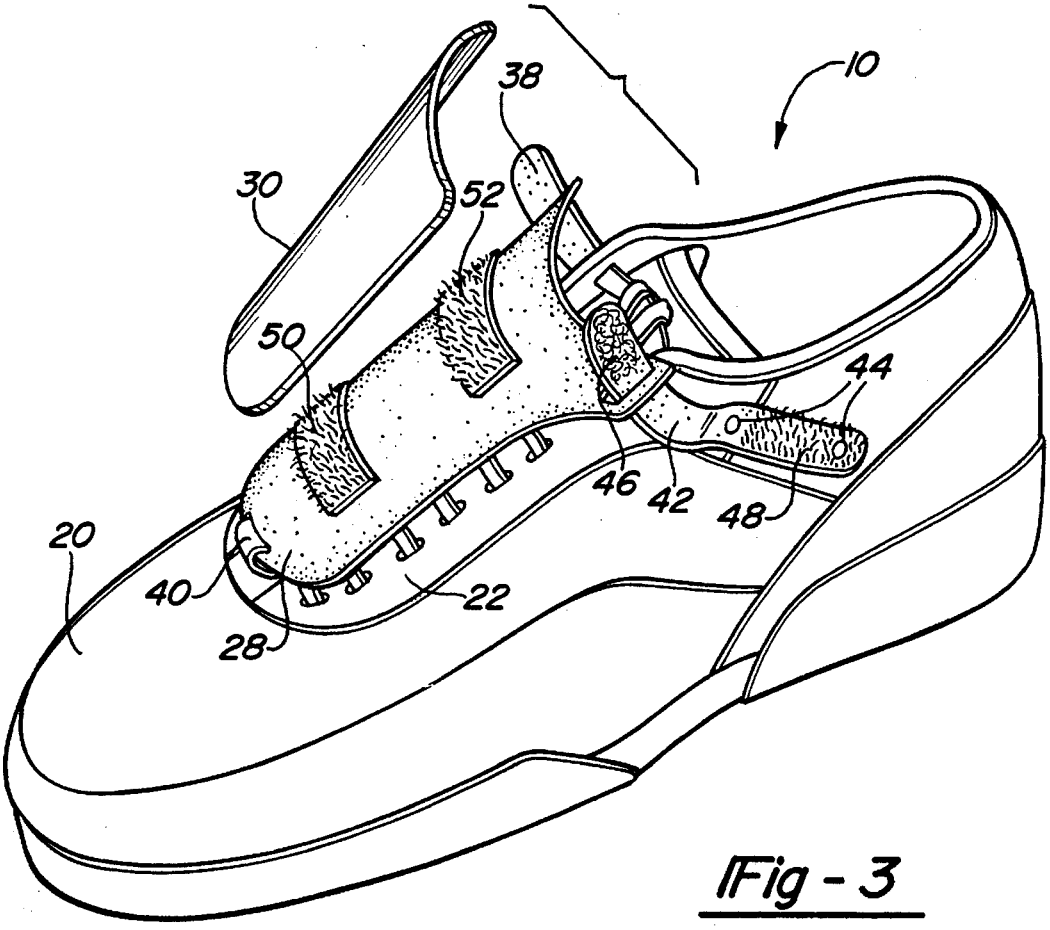
FIG. 3 is a perspective exploded view of the shoe and associated shoelace cover and fashion panel shown in FIG. 1.

Since the shoelace cover 28 covers the shoelace 24 of the shoe 10, the design of the shoelace cover 28 must allow access of the wearer to the shoelace 24 such that the wearer can secure the shoe 10 to his foot. FIG. 3 shows the manner in which the shoelace cover 28 and the fashion panel 30 are removable from the shoe 10. In this exploded perspective view, the strap 40 is shown secured to the shoelace area 22 at a lower location and still threaded through the slot 34 such that the shoelace cover 28 is pivotally engagable at this location to the shoe 10. The strap 38 is shown detached from the slot 32 and the strap 42 is shown detached from the slot 36. A pair of fastening devices 44, such as rivets, rigidly secure the strap 42 to the upper portion 14 of the shoe 10. Similar rivets (not shown) secure the strap 38 to the upper portion 14. It is to be appreciated that the straps could be removably secured to the shoe if desired, provided the straps can be attached for securement of the cover 28 to the shoe 10.

When the strap 42 is threaded through the slot 32, a loop or hook material 46 at one end of the strap 42 is secured to an opposite hook or loop material 48 at an opposite end of the strap 42 to hold the shoelace cover 28 in place. The strap 38 releasably secures the shoelace cover 28 in a similar manner. In this manner, the shoelace 24 can be completely exposed such that the wearer can lace up the shoe 10 in an ordinary fashion. When the shoelace cover 28 is securely attached to the upper portion 14 of the shoe 10, the straps 38 and 42 will be threaded through the slots 32 and 36, respectively, and be tightened against themselves. It may be possible to secure the shoe 10 to the wearer's foot by tightening the straps 38 and 42 in the manner as just discussed, thus eliminating the need for the shoelace 24.

Attached to the top surface of the shoelace cover 28 by means of glue or the like are two sections of loop hook fastener material 50 and 52. Likewise, attached to the fashion panel 30 by means of glue or the like are two sections of loop or hook material (see FIG. 5) such that when the fashion panel 30 is appropriately aligned with the shoelace cover 28, the sections 50 and 52 align with the sections on the fashion panel 30, and the panel 30 will be adequately secured in place. However, upon removal of the fashion panel 30 from the shoelace cover 28, a replacement fashion panel can be connected to the shoelace cover 28 in a similar manner to provide an alternate fashion statement. Of course, other adequate securing mechanisms can be used as alternates to the loop and hook devices.

Figure 4:
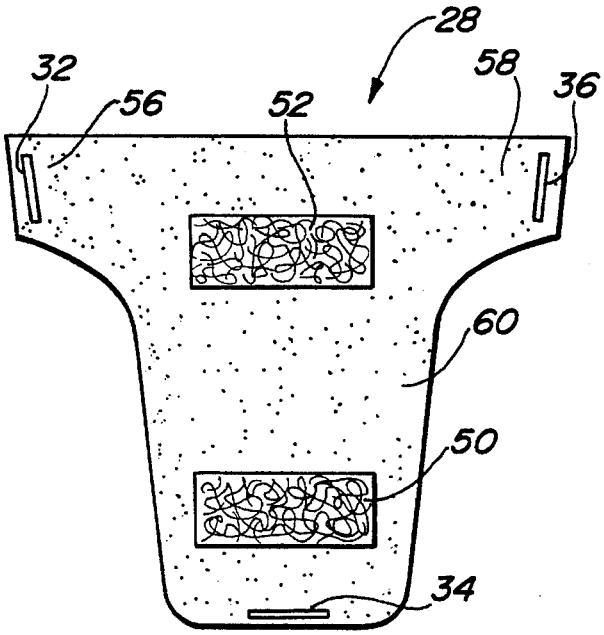
FIG. 4 is a top view of the shoelace cover of FIG. 1 according to a preferred embodiment of the present invention.

Now turning to FIG. 4, a top view of the shoelace cover 28 is shown. As is apparent, the shoelace cover 28 has a predetermined shape which is designed to conform with the shoelace area 22 of the upper portion 14 of the shoe 10. A first winged portion 56 and a second winged portion 58 are included to extend a distance down the sides of the upper portion 14 in order to more adequately conform to the shape of the upper portion 14. The slots 32 and 36 are cut into the winged portions 56 and 58, respectively. The shoelace cover 28 is intended to be of a semi-rigid material. In one preferred embodiment, a semi-rigid plastic base layer having a thickness of approximately 1 mm is conformed to the desirable shape of the shoe 10, and an outer skin or fabric layer 60 is secured to the rigid plastic base layer by means of glue or some other adequate securing method. The layer 60 can match the material of the upper portion 14 of the shoe 10, or be of some other type or design. Of course, the shoelace cover 28 can be a single member of any desirable material, such as leather, plastic, metal, or any other suitable material. Further, the shape and size of the shoelace cover 28 can vary depending on different designs or different shoes.

Figure 5:
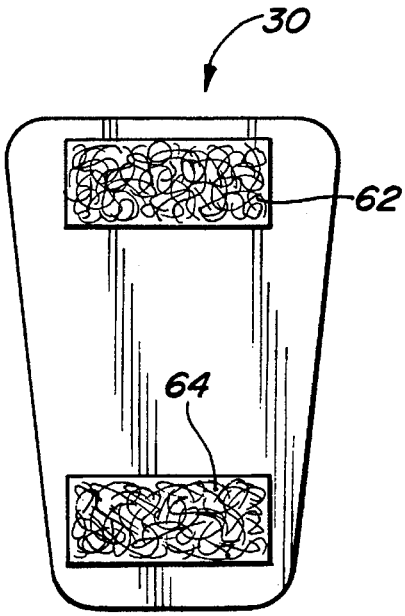
FIG. 5 is a bottom view of the fashion panel according to a preferred embodiment of the present invention.

FIG. 5 shows a bottom view of the fashion panel 30. Like the shoelace cover 28 before it, the fashion panel 30 can come in a variety of different materials and shapes. Attached to the back surface of the fashion panel 30 by means of glue or the like is a pair of sections of loop or hook material 62 and 64. The sections 62 and 64 align with the sections 52 and 50, respectively, when the fashion panel 30 is secured to the shoelace cover 28. In a preferred embodiment, the fashion panel 30 is of a semi-rigid material having a thickness of about 1 mm which is formed to the shape of the shoelace cover 28 on the shoe 10. The fashion panel 30 can be of a semi-rigid plastic material having an outer coating of a fabric or leather material. Further, the fashion panel 30 can be a metal piece having the appropriate shape. It is the fashion panel 30 which is intended to be interchanged with other fashion panels selected from any number of fashion panels having the above described characteristics. The fashion panel 30 can have different colors, different patterns, or different wordings such that the wearer can interchange the fashion panel 30 from one time to the next in order to provide a different fashion statement without having to have a number of different pairs of shoes.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A shoelace cover adaptable to be secured to an upper portion of a shoe having a shoelace area, said shoelace cover comprising:

a base panel, said base panel including first securing means for pivotably securing the base panel to the upper portion of the shoe independently of a shoelace, wherein the first securing means is a series of three straps engagable with a series of three slots in the base panel, a first strap being rigidly secured to one side area of the shoe and being threadably engaged with a first slot in the base panel, a second strap being rigidly secured to an opposite side area of the shoe and being threadably engaged with a second slot of the base panel, and a third strap being rigidly secured to a top area of the shoe and being threadably engaged with a third slot in a lower region of the base panel;

a fashion panel releasably attached to an upper surface of the base panel; and second securing means for securing the fashion panel to the base panel, said second securing means enabling said fashion panel to be readily removable from the base panel such that a shoe wearer can optionally remove and replace the fashion panel with other fashion panels in order to convey differing fashion statements.

2. The shoelace cover according to claim 1 wherein the first and second straps include a loop and hook material such that when the straps are threaded through the first and second slots, the loop and hook material secures a first end of each strap to a second end of the strap so as to enable the base panel to be readily detached from the shoe.

3. The shoelace cover according to claim 1 wherein the second securing means is a loop or hook material attached to a top surface of the base panel and a bottom surface of the fashion panel.

4. The shoelace cover according to claim 1 wherein the base panel is a leather base panel.

5. The shoelace cover according to claim 1 wherein the fashion panel is a metal fashion panel.

6. The shoelace cover according to claim 1 wherein the base panel is a specially shaped plastic member including an outer layer of a material selected from the group consisting of leather and fabric.

7. The shoelace cover according to claim 1 wherein the fashion panel is a specially shaped plastic member including an outer layer of a material selected from the group consisting of leather and fabric.

8. A shoelace cover adaptable to cover shoelaces of a shoe, said shoe including a sole portion and an upper portion wherein the upper portion includes a first side, a second side and a top, said shoelace cover comprising:

a shoelace cover base portion secured to the upper portion of the shoe, said shoelace cover base portion including a first and second slot at opposite sides of an upper portion of the shoelace cover base portion and a third slot at a lower central portion of the shoelace cover base portion;

a first and second strap being rigidly secured to the first and second sides of the shoe and a third strap being rigidly secured to the top of the shoe, said first and second straps being threadably engagable with the first and second slots and the third strap being threadably engagable with the third slot, wherein the first and second straps include first and second release mechanisms such that the first and second straps can be readily released from the first and second slots in order to expose the shoelace of the shoe; and a fashion panel releasably attached to an upper surface of the shoelace cover base portion, said fashion panel including a releasing mechanism such that the fashion panel can be readily removed from the shoelace cover base portion so that a shoe wearer can optionally remove and replace the fashion panel with other fashion panels in order to create a fashion statement.

9. The shoelace cover according to claim 8 wherein the shoelace cover base portion is a leather base portion.

10. The shoelace cover according to claim 8 wherein the shoelace cover base portion is a specially shaped plastic member including an outer layer of a material selected from the group consisting of leather and fabric.

11. The shoelace cover according to claim 8 wherein the fashion panel is a metal fashion panel.

12. The shoelace cover according to claim 8 wherein the fashion panel is a specially shaped plastic member including an outer layer of a material selected from the group consisting of leather and fabric material.

13. A shoelace cover for a shoe having a curved portion for fitting over an upper portion of a foot comprising:

an elongated cover portion for substantially covering a shoelace area of a shoe, said elongated cover portion including a longitudinal curvature for conforming to the curved portion of the shoe and having a first distal end for attachment adjacent a toe area of said shoe and a second distal end for attachment adjacent an ankle opening of the shoe;

a first means for removable attachment of the first distal end to said shoe, wherein said first means for attachment comprises a slot in said first distal end and a strap attached to said shoe and looped through said slot; and a second means for removable attachment of the second distal end to said shoe whereby said shoelace cover can be attached to said shoe for overlying said shoelace area; and said second distal end including a pair of wings extending in a lateral direction wherein each wing of said pair of wings includes a slot therein and wherein said second means for attachment comprises a pair of straps looped through said slots.

14. The shoelace cover of claim 13 further comprising a fashion panel having securing means for removably securing the fashion panel to said elongated cover.

* * * * *